US009452332B1

(12) United States Patent
Nosenkis

(10) Patent No.: US 9,452,332 B1
(45) Date of Patent: Sep. 27, 2016

(54) NIGHT GOLF SYSTEM

(71) Applicant: Roman Nosenkis, Toronto (CA)

(72) Inventor: Roman Nosenkis, Toronto (CA)

( * ) Notice: Subject to any disclaimer, the term of this patent is extended or adjusted under 35 U.S.C. 154(b) by 0 days.

(21) Appl. No.: 14/737,668

(22) Filed: Jun. 12, 2015

Related U.S. Application Data

(60) Provisional application No. 62/154,102, filed on Apr. 28, 2015.

(51) Int. Cl.
*A63B 57/00* (2015.01)
*A63B 69/36* (2006.01)

(52) U.S. Cl.
CPC ..... *A63B 57/00* (2013.01); *A63B 69/3691* (2013.01); *A63B 2207/02* (2013.01)

(58) Field of Classification Search
CPC ..... A63B 2207/00; A63B 2207/02; A63B 69/3691; A63B 57/00; F21W 2131/109; F21Y 2101/02; F21Y 2103/003; F21Y 2103/006
USPC ..... 473/157–176, 180, 181, 185, 195–197; 362/559, 581
See application file for complete search history.

(56) References Cited

U.S. PATENT DOCUMENTS 3,918,719 A * 11/1975 Welch ..... A63B 43/06 273/DIG. 24
4,489,669 A * 12/1984 Carman ..... A63B 57/00 116/202
5,163,684 A * 11/1992 Seidler ..... A63B 57/357 273/371
5,265,875 A * 11/1993 Fitzgerald ..... A63B 69/3697 362/431
5,445,373 A * 8/1995 Franks ..... A63B 43/06 473/150
6,099,139 A * 8/2000 Lapensee ..... A63B 69/3691 362/153.1
6,569,028 B1 * 5/2003 Nichols ..... A63B 69/3694 473/153
6,699,137 B2 * 3/2004 Szymanski ..... A63B 43/06 362/559
7,594,859 B2 * 9/2009 Mullen ..... A63B 57/357 473/175
8,753,218 B2 * 6/2014 Suchanek ..... A63B 57/00 473/169
8,864,333 B2 * 10/2014 Burkart ..... F21V 33/008 362/234
2010/0004068 A1 * 1/2010 Adame ..... A63B 57/357 473/176

* cited by examiner

*Primary Examiner* — Mark Graham
(74) *Attorney, Agent, or Firm* — Michael J. Foycik, Jr.

(57) ABSTRACT

A night golfing system provides an EL wire for outlining features of a golf course, to facilitate night golfing. The system employs a specific color-coding scheme as follows: Green—surrounds the surface of the green; Yellow—surrounds the surface of the bunker; Blue—surrounds or laid out to the side of the water hazard; Red—surrounds or laid out to the side of the hazard line; White—used to outline the walking/riding path and the Tee Box. An LED golf ball can be used with the invention. A specific color coding system is contemplated. Also, in a separate embodiment, LED strips can be used instead of EL wire.

2 Claims, 7 Drawing Sheets

NIGHT GOLF SYSTEM

CROSS REFERENCE TO RELATED APPLICATIONS

This application claims the priority of Provisional Application No. 62/154,102 filed on Apr. 28, 2015, inventor Roman Nosenkis, entitled "Night Golf System". The entire disclosure of this provisional patent application is hereby incorporated by reference thereto, in its entirety.

STATEMENT REGARDING FEDERALLY SPONSORED RESEARCH OR DEVELOPMENT

Not applicable.

FIELD OF THE INVENTION

The present invention relates to a night golf system, wherein features of a golf course are outlined at night. In a specific embodiment, an LED golf ball can be used in this system, along with EL wire.

BACKGROUND OF THE INVENTION

It is a problem in the art to provide a facility for night time golfing. At night, the course is not sufficiently visible. Lighting of the entire course by conventional lighting can be done, but would be very expensive, would require substantial electrical power, and would be expensive to install.

SUMMARY OF THE INVENTION

From the foregoing, it is seen that it is a problem in the art to provide a system meeting the above requirements. According to the present invention, a system is provided which meets the aforementioned requirements and needs in the prior art. Specifically, the system according to the present invention provides an EL wire for outlining features of a golf course, to facilitate night golfing. Here, the term EL refers to electroluminescent ("EL") wire or tape.

The system of the present invention also contemplates use of an LED golf ball, which lights on impact.

The present invention can also include one or more of the following:

- Multicolor wires on a spool with the battery, inverter and charger inside the housing.
- Multicolor flags with el wire, el panels, battery, inverter and charger built in.
- Multicolor arrows (fairway boundary/yardage markers) with el panels, battery, inverter and charger built in.
- Hole Signs with el panels, battery, inverter and charger built in.
- Touchscreen kiosks with live scoring app.
- Recharging station for all the units.
- Transportation Trailer.

The night-golf system is developed using electroluminescent technology and lithium batteries. The night-golf system is not designed in a conventional way by providing the light source, rather it is used to outline all the features of the golf course/driving range, i.e. greens, hazards, tee blocks, fairways, and cart/walking paths.

Other objects and advantages of the present invention will be more readily apparent from the following detailed description when read in conjunction with the accompanying drawings.

DETAILED DESCRIPTION OF THE INVENTION

Figure 1:
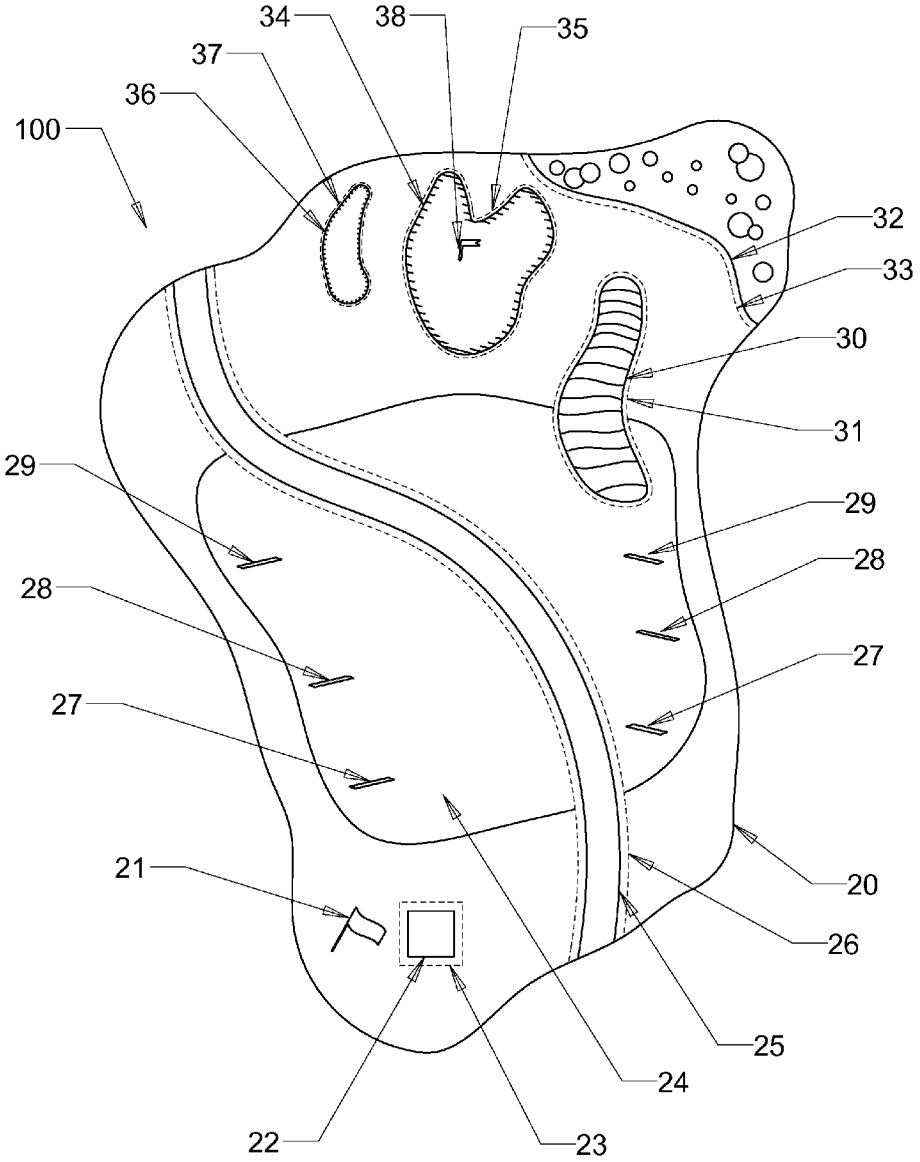
FIG. 1 is a schematic elevational view of a system for a night golf course, according to the present invention.
Figure 10:
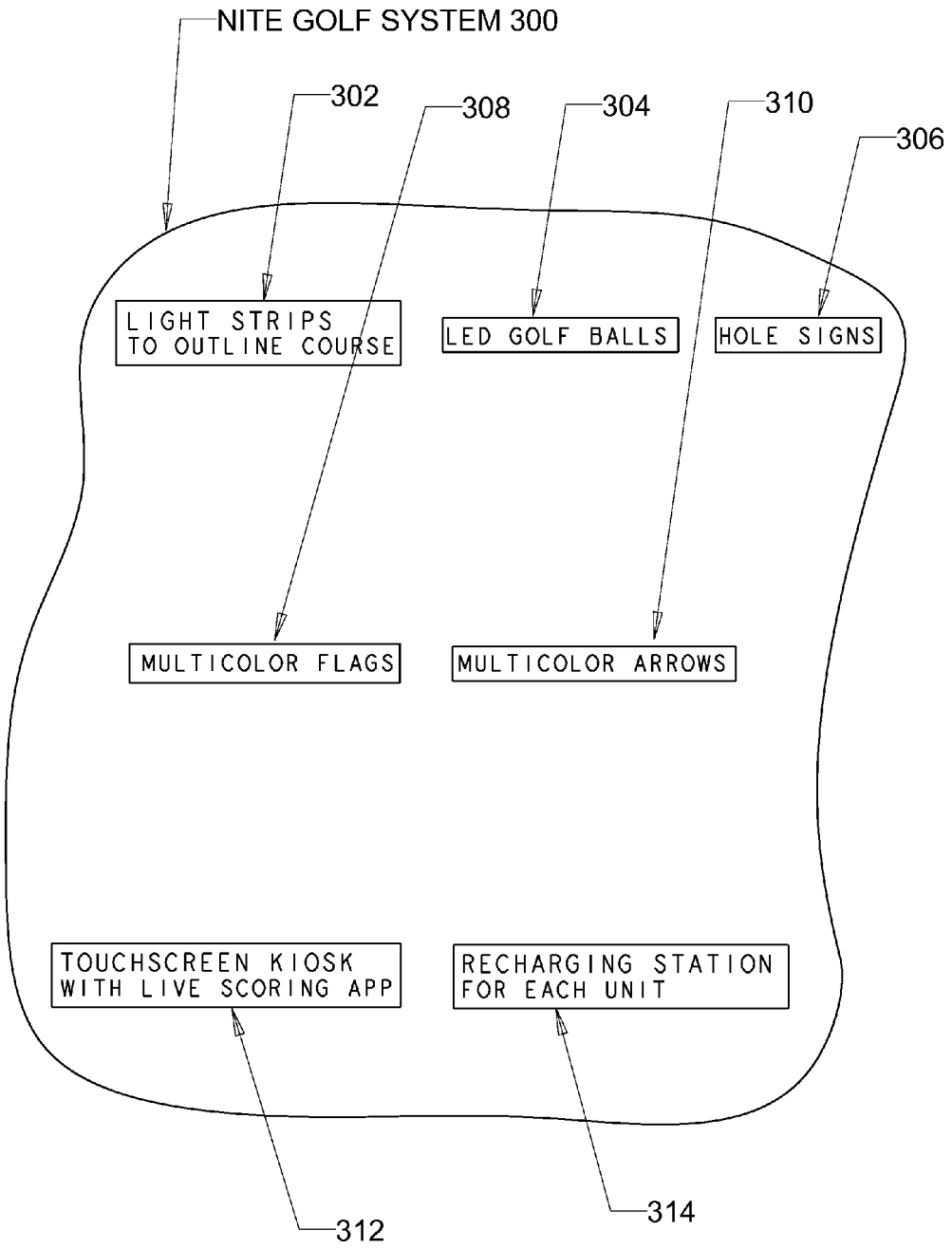
FIG. 10 is a schematic view of a night golf system (also referred to herein as a "nite golf system) which includes light strips to outline a course, LED golf balls, hole signs, multicolor flags, multicolor arrows, at least one touchscreen kiosk with a live scoring app, and a recharging station for each unit.

FIG. 1 is a schematic elevational view of a golf course 100 used in a night golf system 300 (shown in FIG. 10). The features shown in FIG. 1 are discussed below.

The system 100 in a preferred embodiment provides an EL wire or EL tape 114 (seen in FIG. 3) for outlining features of a golf course, to facilitate night golfing. Here, the term EL refers to electroluminescent ("EL") wire or tape which is a well known technology in the lighting arts. The EL wire or tape can be provided with colors. As used herein, wherever the term "EL wire" is used it is also intended that "EL tape" can be used; and vice versa. The system is not limited to EL wire or EL tape, and the lighting wire or lighting strip can instead employ LED wire or LED tape.

The system 100 shown in FIG. 1 employs a specific color-coding scheme as follows:

The multicolor EL wires 114 (i.e., the variously-colored EL wires 114) are used in the following way in the preferred embodiment:

Green—surrounds the surface of the green.

Yellow—surrounds or is laid out to the side surface of the sand bunker.

Blue—surrounds or laid out to the side of the water hazard.

Red—surrounds or laid out to the side of the hazard line.

White—used to outline the walking/riding path and the Tee Box.

The length of the EL wire 114 of each separate unit of the above types is custom made to the specifications of the golf course/driving range.

Figure 2A:
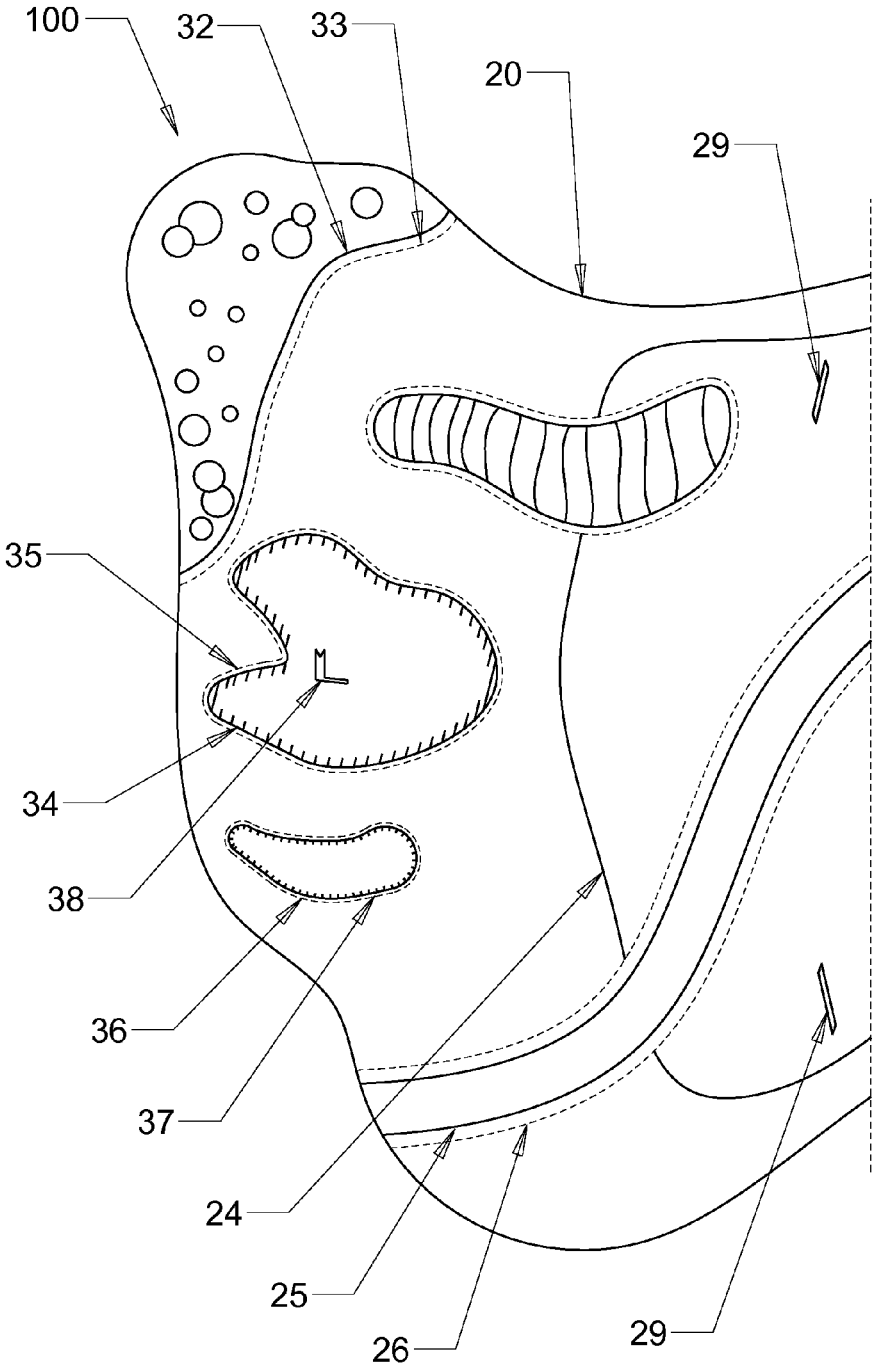
FIG. 2A is an enlarged view of the top portion of FIG. 1.

FIG. 2A is an enlarged view of the top portion of FIG. 1 showing the golf course 100.

Figure 2B:
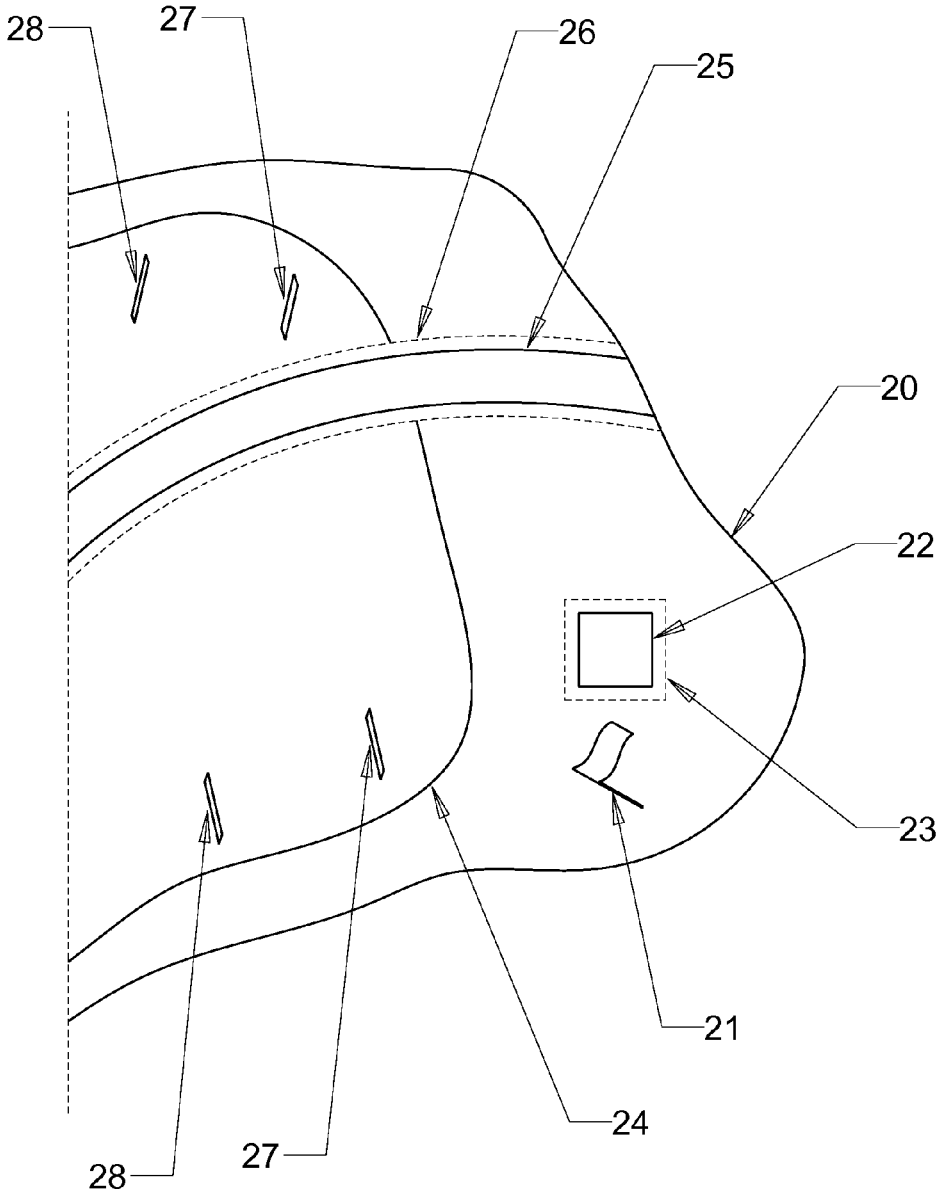
FIG. 2B is an enlarged view of the bottom portion of FIG. 1.

FIG. 2B is an enlarged view of the bottom portion of FIG. 1 showing the golf course 100.

The numerals of FIG. 1, FIG. 2A, and FIG. 2B are as follows:

20 indicates boundaries of a golf hole,
21 indicates an EL Panel hole sign,
22 indicates a Tee Block,
23 indicates a (WHITE) EL wire outlining the tee block,
24 indicates a Fairway,
25 indicates a Cart Path,
26 indicates a (WHITE) EL Wire outlining the cart path,
27 indicates 200 Yard Markers/Fairway boundary markers (BLUE),
28 indicates 150 Yard Markers/Fairway boundary markers (WHITE),
29 indicates 100 Yard Markers/Fairway boundary markers (RED),
30 indicates Water Hazards,
31 indicates (BLUE) EL wire outlining the water hazards,
32 indicates Hazard Lines,
33 indicates (RED) EL Wire outlining the hazard lines,
34 indicates a Surface of the Green,
35 indicates (GREEN) EL wire outlining the surface of the green,
36 indicates a Sand Bunker,
37 indicates (YELLOW) EL wire outlining the sand bunker,
38 indicates a Flag with EL Wire and El Panels, wherein:
a (RED) Flag is for the front of the green
a (WHITE/YELLOW) Flag is for the middle of the green
a (BLUE) Flag is for the back of the green.

The system 100 of the present invention covers the aforementioned concepts, and also specifically covers the specific color combinations used to outline the features of the golf course or driving range as set forth in the above.

In the cases where any particular golf hole (20) has features are too large to surround (i.e. portions in the drawings labeled 22, 25, 30, 32, 34, 36) the EL wire can be placed along but not fully surrounding the feature.

The different color wire can also be used to identify a certain feature even if it is not there in real life. This could thereby create a phantom feature that only appears to exist when seen at night, for example by a golfer at night. This is advantageous in certain circumstances, for example if a real tee block is in an area of the golf hole where it may be dangerous to get to without the light of day, the white wire can be placed somewhere in the middle of the fairway to make the golf hole easier to play in the dark. Features of the golf hole do not actually have to be there in order to be identified by the EL wire. For example: a golf cart path may not be present on the golf course but putting the white wire down through the middle of the fairway will create a cart path for a safe passage at night.

Basically, whether the features of a particular golf hole are there or not, according to the foregoing color scheme or color chart, the features can be either identified or created. The same goes for the driving range. Features like sand bunkers, greens, water hazards and so on can be created using a particular EL color wire, even if the features are not there.

Figure 3:
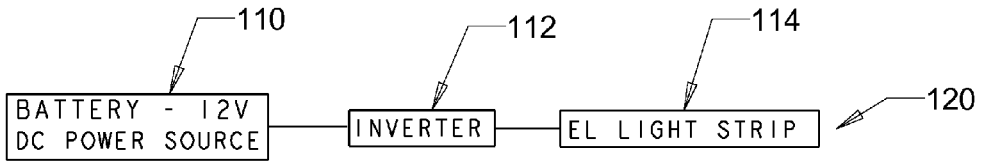
FIG. 3 is a schematic view of an EL light strip with a power supply and an inverter.

FIG. 3 is a schematic view of an EL light strip 114 with a power supply 110 and an inverter 112. Here, the power supply 110 is shown as a 12 V battery DC power source. Other types of batteries, battery voltages, and/or other types of power sources, can also be used as the power supply 110. Also, the terminology EL light strip 114 is contemplated to also include EL wire. The inverter is selected to convert the DC voltage to a suitable current supply for the EL light strip 114, and such inverters are well known in the electrical arts.

Figure 4:
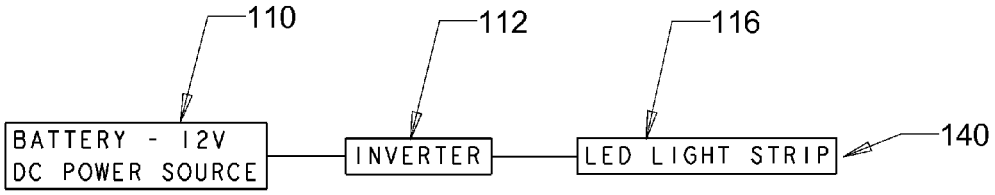
FIG. 4 is a schematic view of an LED light strip with a power supply and an inverter.

FIG. 4 is a schematic view of a further embodiment of the present invention, wherein an LED light strip 116 is powered by the above-described power supply 110 and the inverter 112. In this view, the use of LED lights is provided, instead of the EL lighting. The light strip 116 can be replaced by LED wire, and this alternative is contemplated as being within the scope of the present invention. Other types of color lighting can be provided, in addition to the above.

Figure 5:
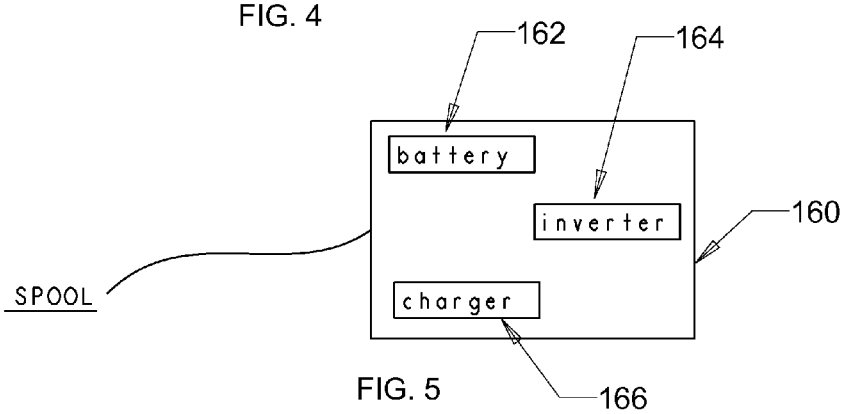
FIG. 5 is a schematic view of a spool which contains a battery, an inverter, and a charger.

FIG. 5 is a schematic view of a spool 160 which contains a battery 162, an inverter 164, and a charger 166. The battery 162 and the inverter 164 can be of the type discussed hereinabove with regard to FIGS. 3 and 4. The charger 166 preferably includes a charger port having connections of types commonly used by electronics which may be carried by a golfer. Thus, the charger 166 can be used to power a cell phone, tablet computer, mp3 player, or other accessory. The spool 160 can be any type of spool, known to any one having skill in the spool arts.

Figure 6:
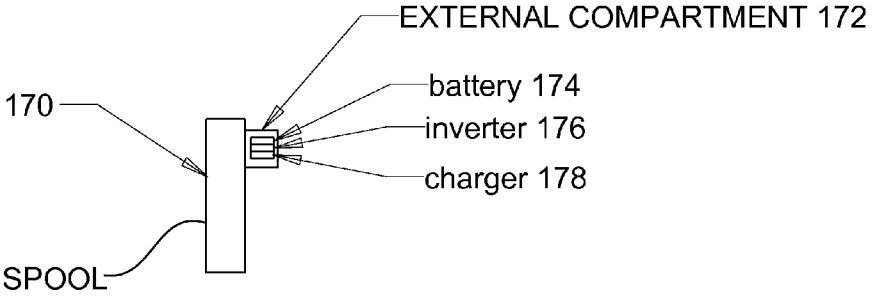
FIG. 6 is a schematic view of a spool which has an externally-mounted battery, an externally-mounted inverter, and an externally-mounted charger.

FIG. 6 is a schematic view of a spool 170 which is schematically shown, and which has an external compartment 172 which carries an externally-mounted battery 174, an externally-mounted inverter 176, and an externally-mounted charger 178. The components 174, 176, and 178 are as described with regard to the above-mentioned FIGS. 3-5.

Figure 7:
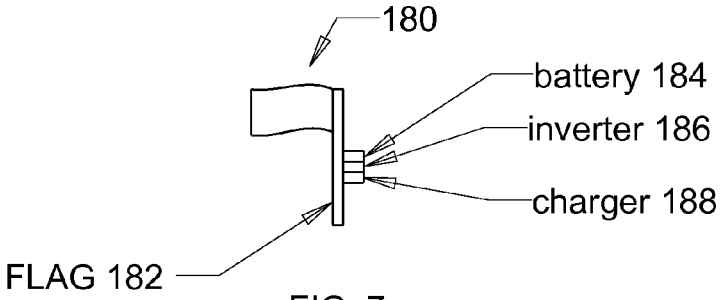
FIG. 7 is a schematic view of a flag which includes a battery, an inverter, and a charger.

FIG. 7 is a schematic view of a flag 180 which includes a battery 184, an inverter 186, and a charger 196. The components 184, 186, and 188 are as described with regard to the above-mentioned FIGS. 3-5.

Figure 8:
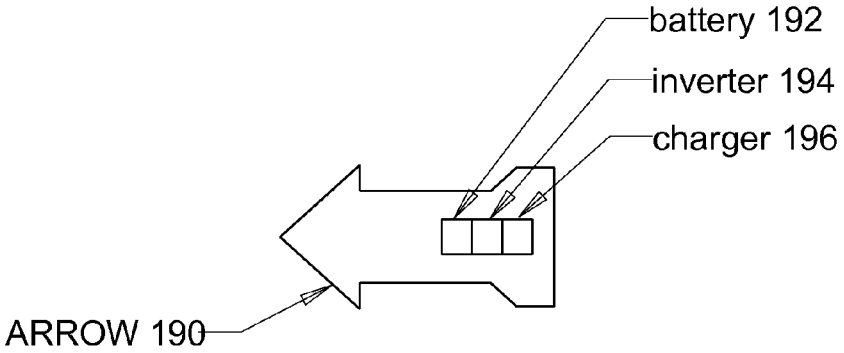
FIG. 8 is a schematic view of an arrow which includes a battery, an inverter, and a charger.

FIG. 8 is a schematic view of an arrow 190 which includes a battery 192, an inverter 194, and a charger 196. The components 192, 194, and 196 are as described with regard to the above-mentioned FIGS. 3-5.

Figure 9:
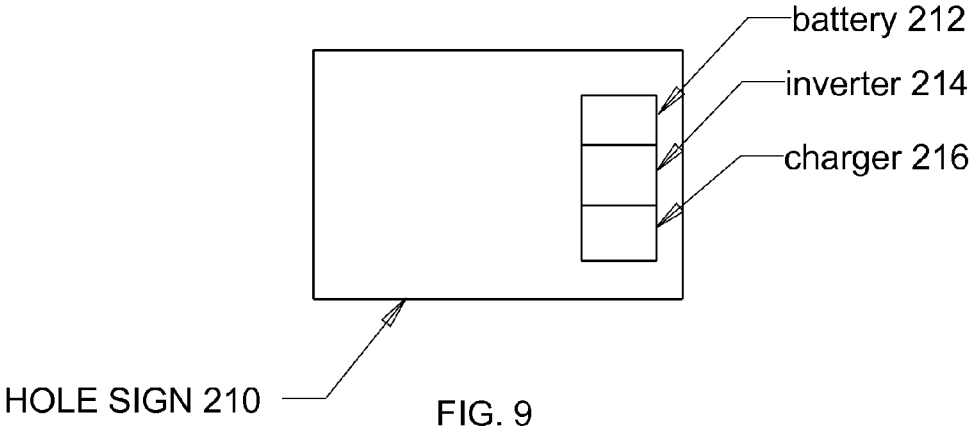
FIG. 9 is a schematic view of a hole sign which includes a battery, an inverter, and a charger.

FIG. 9 is a schematic view of a hole sign 210 which includes a battery 212, an inverter 214, and a charger 216. The components 212, 214, and 216 are as described with regard to the above-mentioned FIGS. 3-5.

FIG. 10 is a schematic view of a night golf system 300 (also referred to herein as a "nite golf system" 300) which includes light strips 302 to outline a course, LED golf balls 304, hole signs 306, multicolor flags 308, multicolor arrows 310, at least one touchscreen kiosk 312 with a live scoring app, and a recharging station 314 for each unit.

Figure 11:
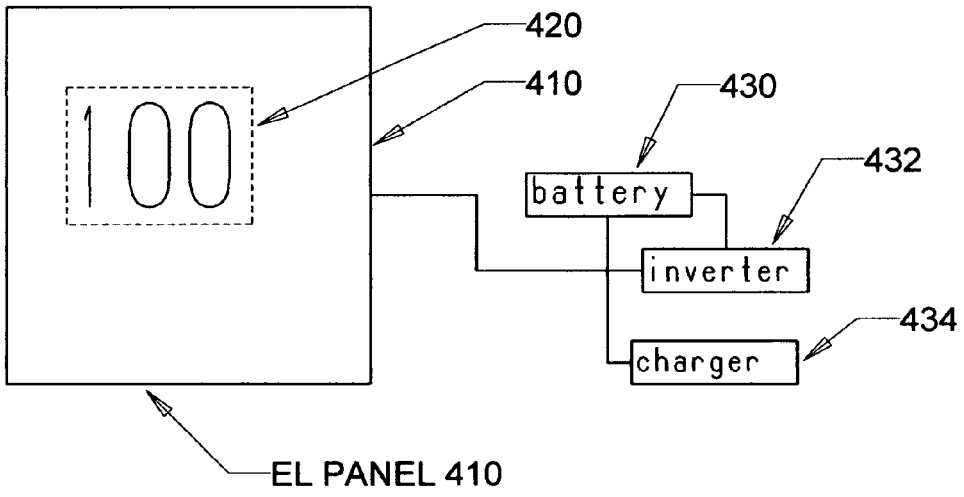
FIG. 11 is a schematic view of an EL panel for use as a yardage marker, which includes a battery, an inverter, and a charger.

The multicolor flags 308 of FIG. 10 include the multicolor EL wire inserted in and/or surrounding the surface of the pin, and the top of the flag is made of one or more EL panels with the battery, inverter, and charger (as described in FIGS. 3-9) inside the top part of the flag 308. The flag is used the following way:

Red Flag—front of the green
Blue Flag—back of the green
White Flag—middle of the green FIG. 11 is a schematic view of an EL panel 410 for use as a yardage marker, which includes a battery 430, an inverter 432, and a charger 434. The EL panel 410 has indicia 420 which indicates yardage, in this case indicating 100 yards. The EL panel 410 preferably has a predominantly red color, and can include other indicia 420 besides the yardage. For example, the indicia can include arrows or other markings. The indicia 420 can be located anywhere on the sign, such as the center, edges, or periphery thereof. Further, the EL panel 410 is not limited to a rectangular shape, and can include other shapes suitable for display of yardage markings Other colors can be used, in conformance with the following yardage distances discussed hereunder.

The multicolor arrows 310 (and also the EL panels 410) can be used as yardage markers and fairway border markers. Once these are placed on the golf course, the player can identify where the edges of the fairways are as well the distance to the green. The arrows 310 are preferably made of an EL panel that is three to twelve feet in length, and wherein the above-described battery, inverter and charger are attached to the back of the unit. The arrows are to be used the following way:

Red Arrows (EL panels)—100 yard marker

White Arrows (EL panels)—150 yard marker

Blue Arrows (EL panels)—200 yard marker

For example, two red Arrows (EL panels) are placed to the sides of the fairway 100 yards away from the green allowing players to identify the edges of the fairway (wide) and an approximate distance to the green. Alternatively the arrows can be used on the driving range to direct traffic.

Hole Signs 306

The hole signs 306 are to be placed at the tee box, and consist with adjustable yardage, so when tee is moved the yardage of the hole can be changed to inform the players, adjustable hole number, so the hole number can be changed on each hole sign making each sign applicable to any hole and golf club/sponsor logo. The hole sign size can be custom fit to the customer's needs.

The touchscreen scoring kiosk 312 with a smart phone app will allow players to keep score of the progress as well as see the scores of others as they happen. The kiosk will also display photos and flyover video of the hole allowing the players to see what the hole looks like in the day time.

The recharging station 314 will allow all units (wires, arrows, hole signs, flags and kiosk) to be charged in one central location with each piece of the system having its own spot for recharging.

A transportation trailer for carrying any or all of the foregoing items, preferably has all the charging stations built in, allowing for mobile use.

In summary, the night-golf system 300 of the present invention is a system having elements that are portable, rechargeable, durable, waterproof and which can be custom made to fit any indoor/outdoor golf course/driving range facility revenue generating system that can be used on a daily basis. The system 300 is used in a way not to use conventional lights to light-up the terrain but rather it keeps the golf facility in the dark of the night, while outlining the characteristics of the set facility.

The white wire that is used to outline the cart path and the tee blocks will also be used to outline the edges of the fairways.

The system of the present invention also contemplates use of an LED golf ball 304, which lights on impact.

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed is:

1. A night golfing system, comprising:

a plurality of light strips in different colors;

a plurality of spools, each spool being associated with a different one of said plurality of light strips; each of said plurality of spools having a battery and inverter for supplying power to an associated one of said plurality of light strips; and multicolor flags each with their own light strip, battery, inverter and charger;

multicolor arrows each with their own light strip, battery, inverter and charger;

hole signs each with their own light strip, battery, inverter and charger.

2. The night golfing system of claim 1, further comprising:

touchscreen kiosks with live scoring app, and a recharging station connectable to external devices.

* * * * *